US006435448B2

(12) United States Patent
Rabe

(10) Patent No.: US 6,435,448 B2
(45) Date of Patent: Aug. 20, 2002

(54) WINDING MACHINE WITH YARN TRAVERSING DEVICE

(75) Inventor: Helmut Rabe, Wehretal (DE)

(73) Assignee: Georg Sahm GmbH & Co. KG, Eschwege (DE)

( * ) Notice: Subject to any disclaimer, the term of this patent is extended or adjusted under 35 U.S.C. 154(b) by 29 days.

(21) Appl. No.: 09/759,839

(22) Filed: Jan. 11, 2001

(30) Foreign Application Priority Data

Jan. 14, 2000 (DE) ..... 100 01 303

(51) Int. Cl.[7] ..... B65H 54/30; B65H 57/28

(52) U.S. Cl. ..... 242/483.7; 242/157.1; 242/483.5

(58) Field of Search ..... 242/483.7, 483.5, 242/483.6, 157.1

(56) References Cited

U.S. PATENT DOCUMENTS

| | | | | |
|---|---|---|---|---|
| 3,401,894 A | * | 9/1968 | Campbell, Jr. | 242/483.7 |
| 3,980,252 A | | 9/1976 | Tae | 242/158.3 |
| 4,025,003 A | * | 5/1977 | Kawauchi et al. | 242/483.5 |
| 4,116,396 A | * | 9/1978 | Fluck | 242/483.7 |
| 5,033,692 A | | 7/1991 | Holcomb | 252/158.3 |
| 5,141,172 A | | 8/1992 | Holcomb | 242/158.3 |
| 5,762,277 A | * | 6/1998 | Uedinger et al. | 242/483.5 |
| 6,119,973 A | * | 9/2000 | Galloway | 242/483.7 |

FOREIGN PATENT DOCUMENTS

| | | | |
|---|---|---|---|
| CH | 423 083 | 10/1965 | |
| DE | 687 619 | 10/1963 | |
| DE | 37 21 139 A1 * | 2/1988 | 242/157.1 X |
| DE | 40 16 104 A1 | 11/1990 | |

* cited by examiner

*Primary Examiner*—Michael R. Mansen
*Assistant Examiner*—Minh-Chau Pham
(74) *Attorney, Agent, or Firm*—Thomas, Kayden, Horstemeyer & Risley, LLP

(57) ABSTRACT

A winding machine (1) includes a yarn traversing apparatus (2) including a housing (3) having an elongated opening (11). A reversing screw thread shaft (5) has an outer surface (14), it is rotatably supported in the housing (3) and it includes an endless screw thread groove (4). A traversing yarn guide (6) includes a body (7), a shuttle (8) being designed and arranged to engage the endless screw thread groove (4), a yarn guide (9) and a guide bush (12) having an inner surface (13). The traversing yarn guide (6) is designed and arranged to be driven by the reversing screw thread shaft (4) to reciprocate in an axial direction. The yarn guide (9) is designed and arranged to project out of the elongated opening (11) of the housing (3). The inner surface (13) of the guide bush (12) is designed and arranged to at least partially surround the outer surface (14) of the reversing screw thread shaft (5).

30 Claims, 6 Drawing Sheets

WINDING MACHINE WITH YARN TRAVERSING DEVICE

CROSS REFERENCE TO RELATED APPLICATIONS

This application claims the benefit of co-pending German Patent Application No. 100 01 303.1 entitled "Spulmaschine", filed on Jan. 14, 2000.

FIELD OF THE INVENTION

The present invention generally relates to a winding machine including a yarn traversing apparatus. Preferably, the winding machine is an apparatus for winding up continuously arriving yarn on bobbins. However, the invention is also applicable to other types of winding machines. The present invention also relates to a yarn traversing apparatus.

BACKGROUND OF THE INVENTION

A winding machine is known from German patent application No. 195 36 761 A1. The winding machine includes a yarn traversing apparatus including a housing. A drivable reversing screw thread shaft is supported inside the housing to be rotatable therein. The reversing screw thread shaft includes an endless screw thread groove. A traversing yarn guide includes a body, a shuttle engaging the groove of the shaft and a yarn guide. The traversing yarn guide is driven by the groove to move back and forth in an axial direction. The housing includes an elongated opening through which the yarn guide of the traversing yarn guide protrudes out of the housing. The winding machine further includes two guide rods for radially guiding the traversing yarn guide. For this purpose, the two guide rods are arranged parallel with respect to one another, and the body of the traversing yarn guide is connected to the parallel guide rods. The body includes two round bores through which the cylindrical guide rods extend. The guide rods extend over the entire length of the screw thread shaft and over the region of the screw thread shaft in which the endless screw thread groove is located, respectively. To prevent the traversing yarn guide from getting jammed at the guide rods, the two guide rods have to be assembled to be exactly parallel. The separate guide rods have to be manufactured, hardened and ground. It is a very important to exactly align the two guide rods during assembly.

Another winding machine is known from German patent No. 196 42 473 C1. The winding machine includes a yarn traversing apparatus including a housing, a reversing screw thread shaft and a traversing yarn guide. Two parallel guide bars are located at the housing in a way that they contact the body of the traversing yarn guide to guide it in a radial direction. The guide bars have to be separately manufactured, hardened and ground in the contact region to the body of the traversing yarn guide. Then, the guide bars have to be screwed to the housing. For this connection, a respective milled, plain surface is required at the housing. The milled surface causes the housing to be structurally weakened. The process of manufacturing, hardening and grinding the guide bars is rather complex and expensive.

SUMMARY OF THE INVENTION

The present invention relates to winding machine. The winding machine includes a yarn traversing apparatus including a housing having an elongated opening. A reversing screw thread shaft has an outer surface, it is rotatably supported in the housing and it includes an endless screw thread groove. A traversing yarn guide includes a body, a shuttle being designed and arranged to engage the endless screw thread groove, a yarn guide and a guide bush having an inner surface. The traversing yarn guide is designed and arranged to be driven by the reversing screw thread shaft to reciprocate in an axial direction. The yarn guide is designed and arranged to project out of the elongated opening of the housing. The inner surface of the guide bush is designed and arranged to at least partially surround the outer surface of the reversing screw thread shaft.

The present invention also relates to a yarn traversing apparatus. The yarn traversing apparatus includes a housing having an elongated opening. A reversing screw thread shaft has an outer surface, it is rotatably supported in the housing and it includes an endless screw thread groove. A traversing yarn guide includes a body, a shuttle being designed and arranged to engage the endless screw thread groove, a yarn guide and a guide bush having an inner surface. The traversing yarn guide is designed and arranged to be driven by the reversing screw thread shaft to reciprocate in an axial direction. The yarn guide is designed and arranged to project out of the elongated opening of the housing. The inner surface of the guide bush is designed and arranged to at least partially surround the outer surface of the reversing screw thread shaft.

With the novel winding machine and the novel yarn traversing apparatus, the traversing yarn guide is guided and supported in a radial direction in the inside of the housing and directly at the reversing screw thread shaft, but no longer outside of the housing and in the region of the elongated opening of the housing, as it is known from the prior art. This novel way of supporting the traversing yarn guide is rather cheap, and it may be are realized with a rather little number of components.

The outer circumferential surface of the reversing screw thread shaft is at least partially surrounded and enclosed by the inner circumferential surface of the guide bush of the traversing yarn guide. The guide bush at least surrounds the reversing screw thread shaft by more than 180 degrees to secure and support the traversing yarn guide in a radial direction. With the present invention, additional, separate guide elements, as guide rods or guide bars, are not required. The number of structural elements of the winding machine and of the yarn traversing apparatus is advantageously reduced. Since the reversing screw thread shaft usually is already ground for the contact to the shuttle of the traversing yarn guide, no additional operational step is necessary during the manufacture of the shaft to realize the novel function of the radial guidance of the traversing yarn guide. The manufacture of the housing of the yarn traversing apparatus is advantageously simplified since the region of the elongated opening does not have to provide for the radial support of the traversing yarn guide. Since only very little material has to be taken of the housing (compared to the material that has to be taken of the housing in case guide rods will be connected to the housing), the structural stability of the housing is improved. The inner circumferential surface of the guide bush and the outer circumferential surface of the shaft together form a relatively great supporting surface for the traversing yarn guide in a radial direction. Consequently, wear and tear occurring at the traversing yarn guide is reduced.

Preferably, the inner circumferential surface of the guide bush and the outer circumferential surface of the reversing screw thread shaft are ground, and they together form a sliding fit. As it has already been explained, the outer circumferential surface of the reversing screw thread shaft usually is already ground for the contact to the shuttle. Consequently, no additional operational step is necessary. Additionally, the inner surface of the guide bush is ground to realize a precise axial relative movement between the guide bush of the traversing yarn guide and the reversing screw thread shaft. Preferably, the guide bush only extends over a small axial portion of the shaft in a way that the surface of the guide bush that has to be ground is rather small. In this way, the grinding process of the inner circumferential surface of the guide bush takes less time, and it is less expensive.

The guide bush may be designed to be circumferentially closed. This means that the guide bush together with the body of the traversing yarn guide encloses the entire circumference of the reversing screw thread shaft. Such an arrangement has the advantage of very securely guiding the traversing yarn guide on the circumference of the reversing screw thread shaft in a radial direction. Tube material may be easily used for the manufacture of the guide bush. The guide bush and the body of the traversing yarn guide, respectively, include a bore into which the shuttle is being inserted to be freely rotatable in the bore. The shuttle has to be freely rotatable to prevent it from being destroyed when moving through the reverse location of the thread channel of the reversing screw thread shaft.

However, the guide bush may instead be designed to be partially open in a circumferential direction. The guide bush at least has to be closed to an extent preventing it from being removed from the reversing screw thread shaft in a radial direction and guaranteeing the radial support of the traversing yarn guide. This means that the guide bush surrounds the circumference of the shaft by at least a little more than 180 degrees. The partially open design of the guide bush provides for the advantage of the mass and of the weight, respectively, of the guide bush and of the entire traversing yarn guide being reduced. The inner surface of the guide bush of which the quality is improved by grinding is less than the surface in the closed design of the guide bush. In this way, the necessary expenditure for grinding is further reduced. It is also possible to reduce the mass of the guide bush by radial bores or the like.

The reversing screw thread shaft may include a plurality of endless screw thread grooves each being designed and arranged to drive one traversing yarn guide. The screw thread grooves are spaced apart in an axial direction in a way that the traversing yarn guides also moves in an axially spaced apart manner. Depending on the respective mounted position of the traversing yarn guides, they respectively move with respect one another. The traversing yarn guides may be inserted into the screw thread grooves to always move at the same distance with respect to one another. However, the traversing yarn guides may also operated non-equiphase.

The yarn traversing apparatus may include two yarn guides being spaced apart by 180 degrees. Accordingly, the housing includes two elongated openings being spaced apart by 180 degrees. In this way, two yarn guides may be used to simultaneously wind the yarn onto two separate bobbins.

The yarn traversing apparatus may further include a sealing strip being designed and arranged to cover and to protect the elongated opening of the housing. The traversing yarn guide may further include a cover or lid being connected to the body of the traversing yarn guide. The cover and the body are arranged to form a gap between them. The sealing strip is designed and arranged to extend through the gap. In this way, dirt, dust, impurities and especially rubbed-off parts of yarn are prevented from entering the interior of the housing of the yarn traversing apparatus and from reaching the reversing screw thread shaft. Generally, there is the problem with winding machines that the rubbed-off parts of yarn enter the housing of the yarn traversing apparatus through the elongated opening, and they settle on the thread groove of the screw thread shaft.

The rubbed-off parts of yarn bond with grease being located inside the housing for lubricating the screw thread shaft, and the resulting viscous mixture has a negative influence on the movement of the traversing yarn guide. The consumption of energy of the winding machine increases with the friction increasing due to the present impurities. There is the danger of the traversing yarn guide getting caught at the particles of dirt, and consequently getting damaged. For example, such impurities cause a destruction of the shuttle of the traversing yarn guide. The new way of sealing the yarn traversing apparatus effectively prevents impurities from entering the region of the reversing screw thread shaft. The drive of the traversing yarn guide, meaning the reversing screw thread shaft including the groove, is located in the winding region. Consequently, the yarn traversing apparatus has advantageously compact dimensions.

The new way of sealing the yarn traversing apparatus of the winding machine may also be applied without using the new guide bush for radially guiding the traversing yarn guide, and it still provides great advantages. Especially in case the sealing strip with its two ends is fixedly connected to the housing, the sealing strip effectively seals and protects the elongated opening of the housing. For this purpose, the housing in the region of its walls enclosing the elongated opening has a plain, flat surface being produced by milling. Except its region contacting the traversing yarn guide, the sealing strip is supported on this plain surface. In the region of the traversing yarn guide, the sealing strip is being lifted in a direction away from the housing. In this region, the traversing yarn guide itself fulfills the function of covering and sealing the elongated opening of the housing. During the axial movement of the traversing yarn guide, the traversing yarn guide slides along the stationary sealing strip. Thus, a relative movement occurs between the sealing strip and the air gap of the traversing yarn guide. In other words, the traversing yarn guide with its cover moves over the sealing strip.

Two holding-down elements extending in a downward direction towards the elongated sealing element may be arranged at the cover. The holding-down elements serve to hold down the sealing strip outside the region of the traversing yarn guide, and they prevent impurities from penetrating into the interior of the traversing yarn guide and into the region of the reversing screw tread shaft. The sealing strip is designed as one piece, and it has a length approximately corresponding to the length of the elongated opening of the housing. For the dimensioning and the assembly of the sealing strip at the housing, it has to be taken into account that a respective additional length of the sealing strip is required to overcome the radial distance between the supporting surface for the sealing strip and the air gap.

The required length of the sealing strip also depends on its material and on its elasticity. Preferably, the sealing strip is designed as a hardened and ground elongated strip being made of steel. This structure provides for the advantage of the sealing strip having good form stability and low friction at low wear and tear. The sealing strip a may also be made of an appropriate different material, for example, a plastic texture including enclosed fiberglass. It is always desired to attain low friction, little wear and tear, sufficient form stability and sufficient flexibility of the sealing strip. The width of the air gap preferably is slightly less than the thickness of the sealing strip. For example, the thickness of the sealing strip may be approximately 0.5 mm. During the assembly of the sealing strip, the sealing strip is subjected to tension to ensure a complete, flat support and contact of the sealing strip on the housing.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
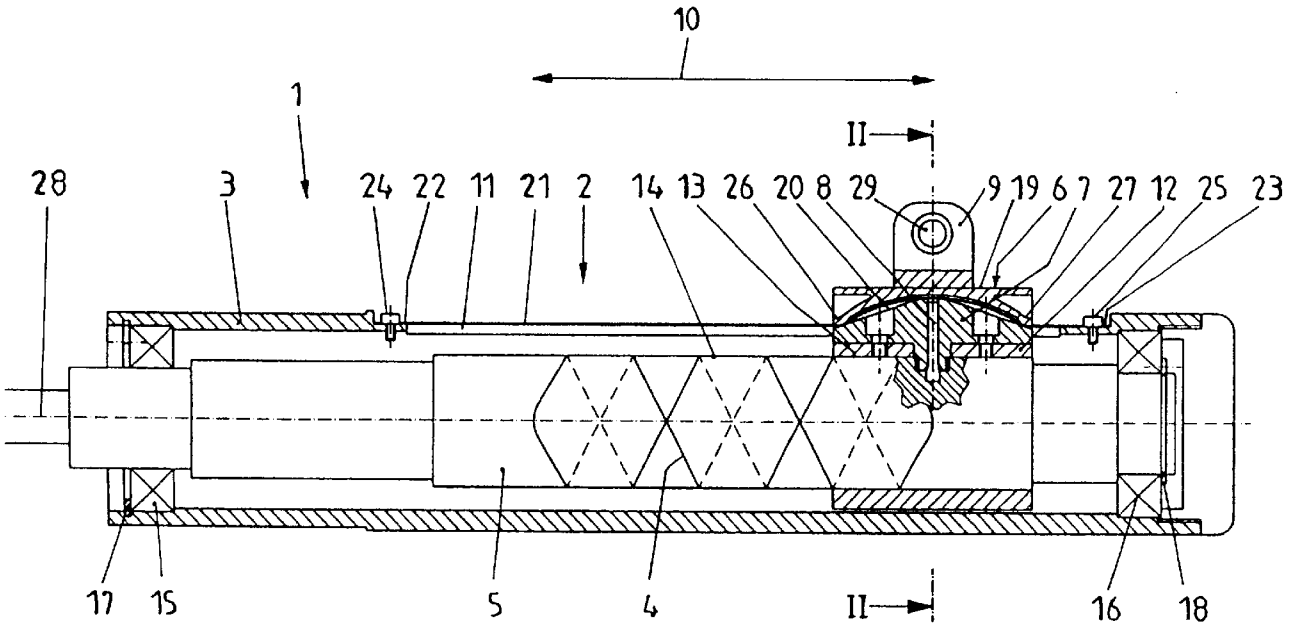
FIG. 1 is a sectional view of a first exemplary embodiment of the novel winding machine including the novel yarn traversing apparatus.

Referring now in greater detail to the drawings, FIG. 1 illustrates a longitudinal sectional view of a part of a winding machine 1 including a yarn traversing apparatus 2. Only the elements of the winding machine 1 being essential for the understanding of the present invention are illustrated in FIG. 1. The general structure of a winding machine is well known in the art.

Figure 12:
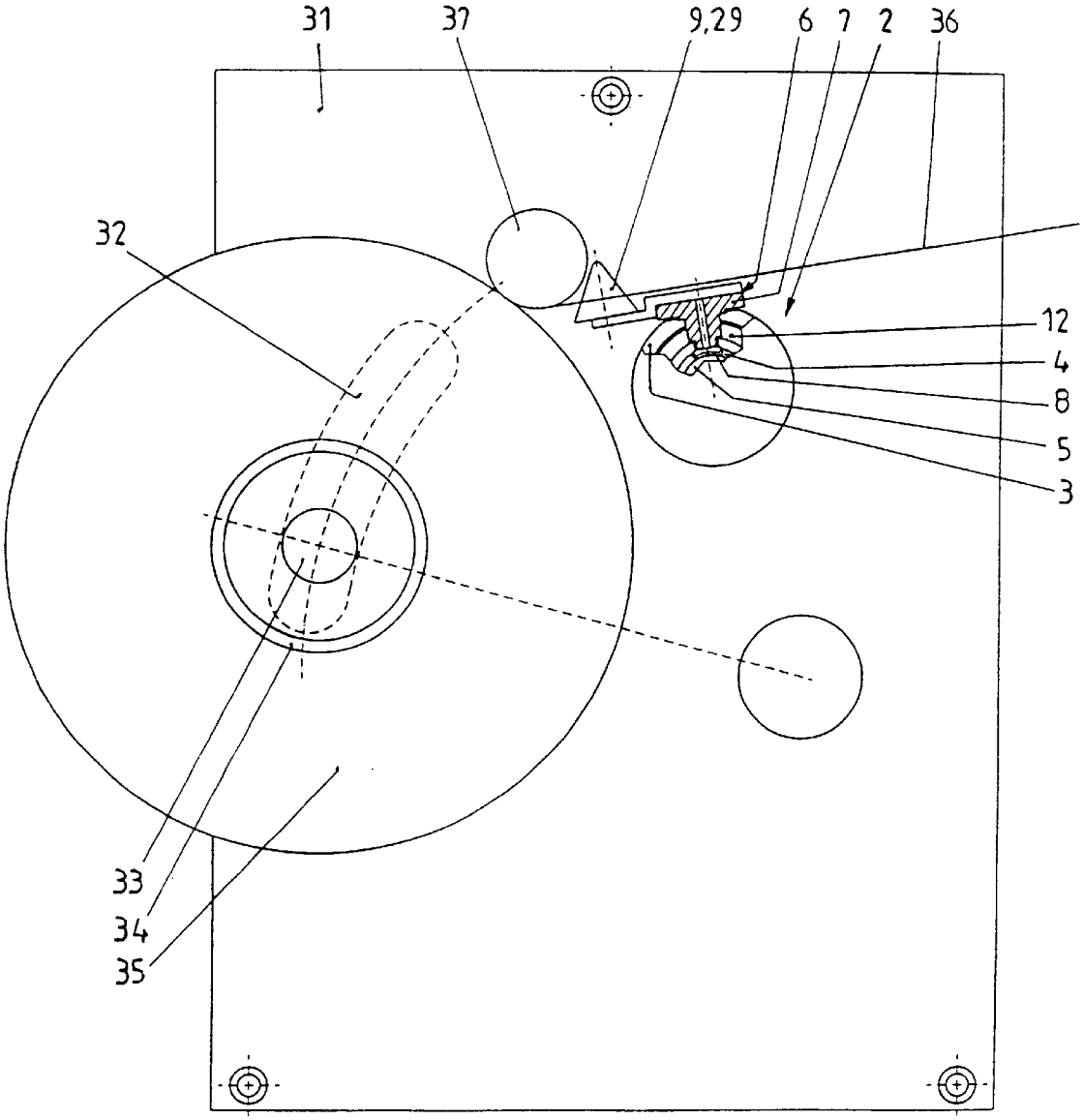
FIG. 12 is a schematic view of the general arrangement of the winding machine including the yarn traversing apparatus.

The yarn traversing apparatus 2 includes a housing 3 in which a reversing screw thread shaft 5 is supported to be rotatably driven. The drive of the reversing screw thread shaft 5 is not illustrated, and it is not essential for the understanding of to the present invention. The reversing screw thread shaft 5 includes an endless screw thread groove 4. The winding machine 1 further includes a traversing yarn guide 6 including a body 7, a shuttle 8 engaging the groove 4 of the shaft 5 and a yarn guide 9. The traversing yarn guide 6 is designed and arranged to be translationally driven by the rotating shaft 5 in a way that it reciprocates in an axial direction in the region of the thread groove 4 according to double arrow 10. The housing 3 in its upper region includes an elongated, slit-like opening 11 through which the yarn guide 9 and further elements of the traversing yarn guide 6 protrude out of the housing 3 to be capable of getting in contact with the yarn 36 (FIG. 12). The traversing yarn guide 6 includes a guide bush 12 being designed and arranged to guide and support the traversing yarn guide 6 with respect to the housing 3 in a radial direction. The guide 6 has an inner surface 13 surrounding the outer surface 14 of the shaft 5. It is to be seen from FIG. 2 that the illustrated embodiment of the guide bush 12 is designed to be circumferentially closed. The inner circumferential surface 13 of the guide bush 12 and the outer circumferential surface 14 of the shaft 5 are ground, and they together form the sliding fit. In this way, the traversing yarn guide 6 is guided and supported precisely, without clearance or looseness and at low friction during its translational movement with respect to the rotating screw thread shaft 5. The traversing yarn guide 6 is guided and supported in a tangential direction by the walls of the housing 3 surrounding the elongated opening 11. Thus, the traversing yarn guide 6 fulfills an exact translational movement in the direction of the elongated opening 11 without essentially moving in a radial direction or in a tangential direction.

The rotating screw thread shaft 5 is supported by bearings 15, 16 and by axial securing rings 17, 18 to be rotatable inside the housing 3 and in a way that it may be connected to a drive (not illustrated). The shaft 5 includes a bigger diameter and a smaller diameter. The endless screw thread groove 4 is located at the bigger diameter of the shaft 5. The shuttle 8 of the traversing yarn guide 6 engages the groove 4 of the shaft 5 in way that—due to the geometry of the shaft 5—a rotating movement of the shaft 5 is transferred into a translational, linear movement of the traversing yarn guide 6 in an axial direction according to double arrow 10. During the axial movement of the traversing yarn guide 6 back and forth in the direction of axis 28 according to double arrow 10, the traversing yarn guide 6 is supported in a radial direction by the contact of the inner circumferential surface 13 of the guide bush 12 to the outer circumferential surface 14 of the shaft 5. A radial direction means a direction perpendicular to the axial direction of the axis 28.

The traversing yarn guide 6 includes a cover 19 being fixedly connected to the body 7 of the traversing yarn guide 6 in a way that the cover 19 and the body 7 form a gap 20 between them. A plain, flat, elongated sealing strip 21 extends in the axial direction of the housing 3 of the yarn traversing apparatus 2, in the direction of the elongated opening 11 and through the gap 20 in way that rubbed-off parts of the yarn, dirt, dust, impurities and the like are prevented from entering the inside of the housing 3. The sealing strip 21 with its two axial ends 22, 23 is fixedly connected to the housing 3 by screws 24, 25. The housing 3 in the region on the border of the opening 11 includes a plain surface being produced by milling. The sealing element 21 contacts the plain surface. The sealing strip 21 has a width being more than the width of the opening 11 in way that the opening 11 is completely closed and covered by the sealing strip 21. Two holding-down elements 26, 27 are located at the cover 19 to extend in a direction towards the sealing strip 21. The elements 26, 27 serve to hold down the sealing strip 21 outside the region of the traversing yarn guide 6 in a direction towards the opening 11. The sealing strip 21 is designed as a hardened and ground strip being made of steel. Consequently, friction and wear and tear resulting from the traversing yarn guide 6 moving with respect to be sealing strip 21 and from the sealing strip 21 sliding through the gap 20, respectively, are substantially reduced.

Figure 2:
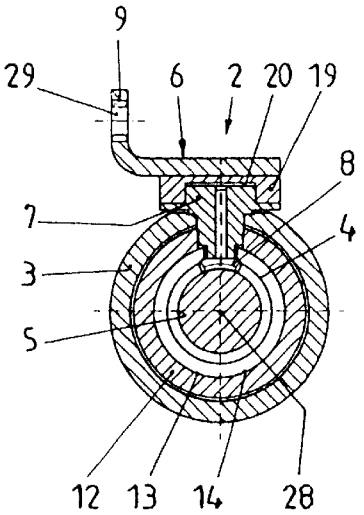
FIG. 2 is a view of a section according to line II—II of the yarn traversing apparatus of FIG. 1.

It is also to be seen from FIG. 2 that the shuttle 8 contacts the base of the thread groove 4 of the reversing screw thread shaft 5, and that it is loosely inserted into a central bore being located in the body 7 of the traversing yarn guide 6. The lid or cover 19 is fixedly but removably connected to the body 7 of the traversing yarn guide 6. Preferably, the cover 19 is connected to the body 7 by a screw connection. Also, the cover 19 is fixedly connected to the yarn guide 9 including an eyelet or lug 29 being designed and arranged to guide the yarn 36.

Figure 4:
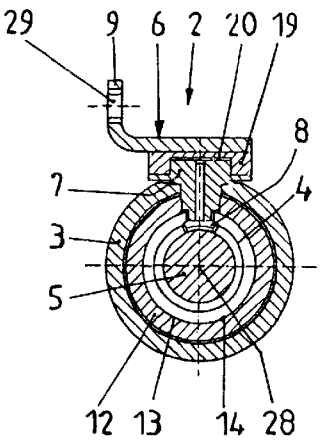
FIG. 4 is a is a view of a section according to line IV—IV of the yarn traversing apparatus of FIG. 3.
Figure 3:
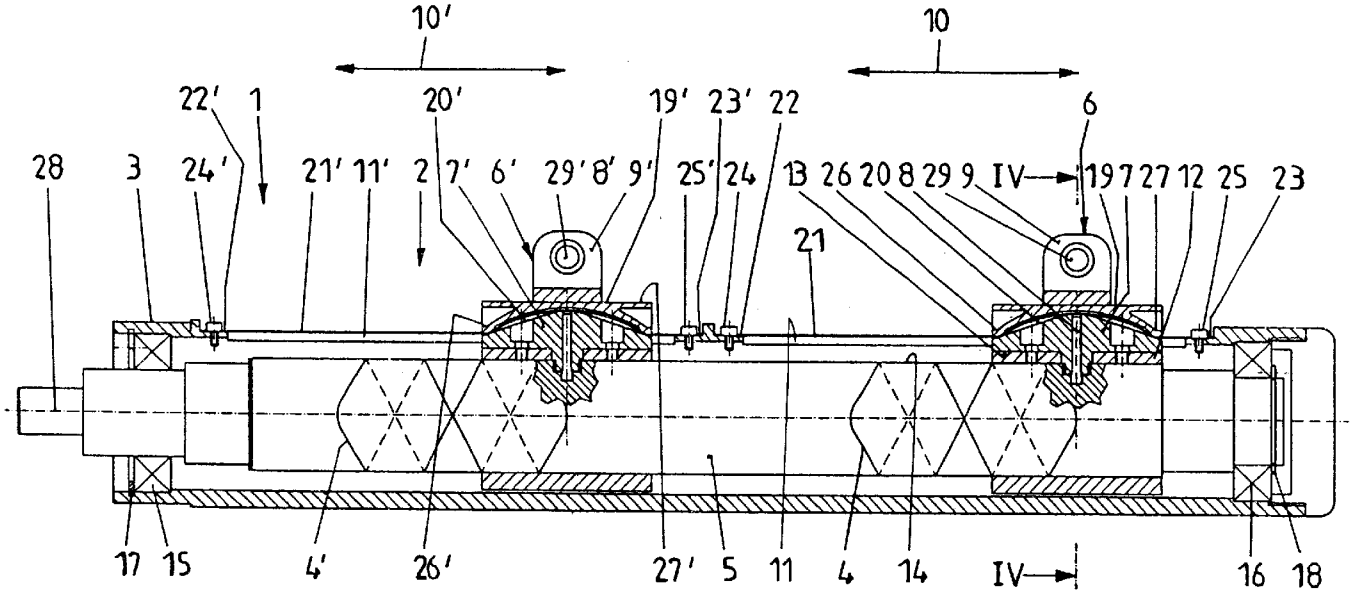
FIG. 3 is a sectional view of a second exemplary embodiment of the winding machine including the yarn traversing apparatus.

FIGS. 3 and 4 illustrate a second exemplary embodiment of the winding machine 1 including a yarn traversing apparatus 2 having a slightly different design. Compared to the embodiment as illustrated in FIGS. 1 and 2, the yarn traversing apparatus 2 according to FIGS. 3 and 4 includes two axially spaced apart screw thread grooves 4, 4' being located in the region of the reversing screw thread shaft 5. Two separate traversing yarn guides 6, 6' are designed and arranged to move back and forth in the respective grooves 4, 4' . Accordingly, they are two separate openings 11, 11' and two separate sealing strips 21, 21'. With this arrangement, two traversing yarn guides 6, 6' may be driven by only one reversing screw thread shaft 5. Depending on the mounted position of the traversing yarn guides 6, 6', there either occurs an equidistant movement and an equiphase movement, respectively, of the traversing yarn guides 6, 6' with respect to one another or a non-equiphase movement. FIG. 3 illustrates an equiphase movement of the traversing yarn guides 6, 6'.

Figure 6:
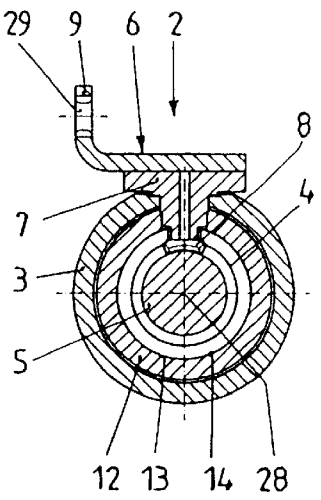
FIG. 6 is a view of a section according to line VI—VI of the yarn traversing apparatus of FIG. 5.
Figure 5:
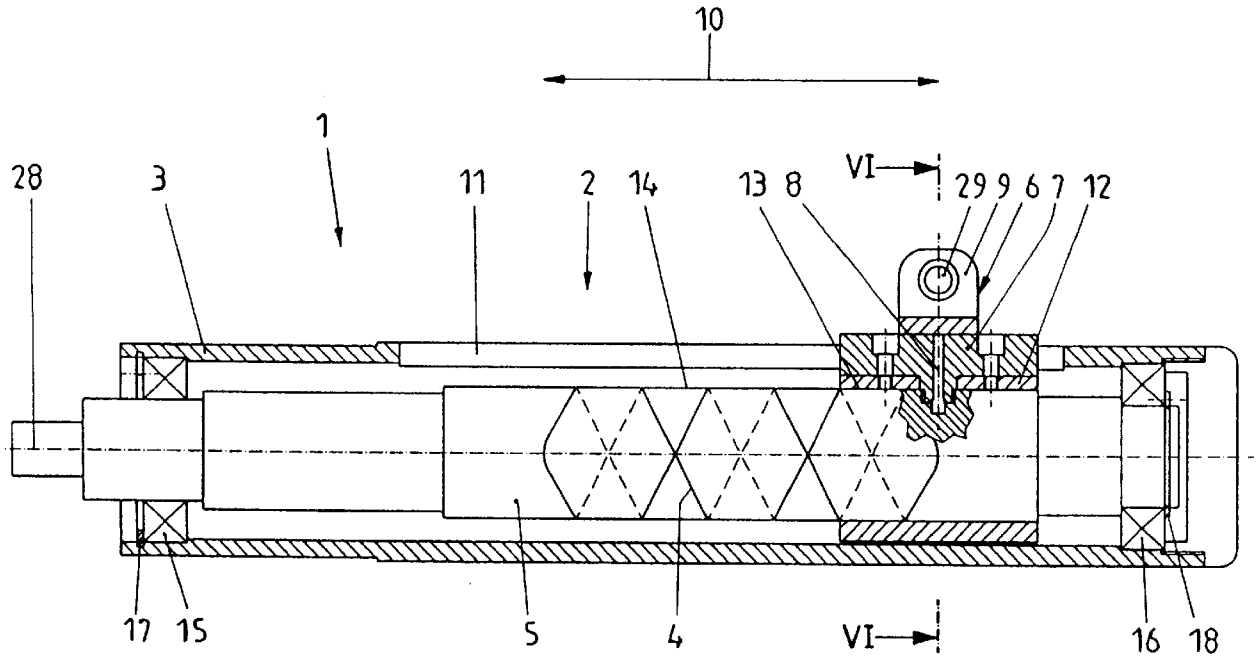
FIG. 5 is a sectional view of a third exemplary embodiment of the winding machine including the yarn traversing apparatus.

FIGS. 5 and 6 illustrate a third exemplary embodiment of the winding machine 1 including the yarn traversing apparatus 2. The yarn traversing apparatus 2 again includes a slit-like elongated opening 11. In this case, there is no sealing strip closing the opening 11. The housing 3 is not sealed or covered. This means that the novel way of radially securing the traversing yarn guide 6 has been realized without the novel way of sealing the opening 11 of the housing 3 of the yarn traversing apparatus 2. Accordingly, the traversing yarn guide 6 does not need a cover and a gap being formed between the cover and the body 7.

Figure 8:
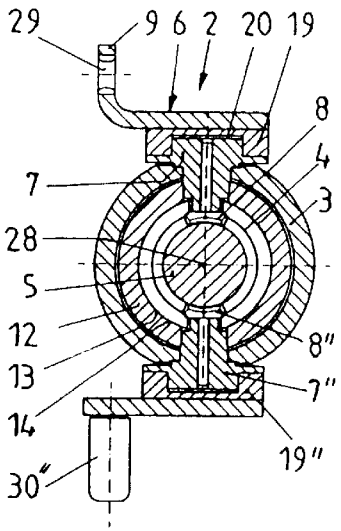
FIG. 8 is a view of a section according to line VIII—VIII of the yarn traversing apparatus of FIG. 7.
Figure 7:
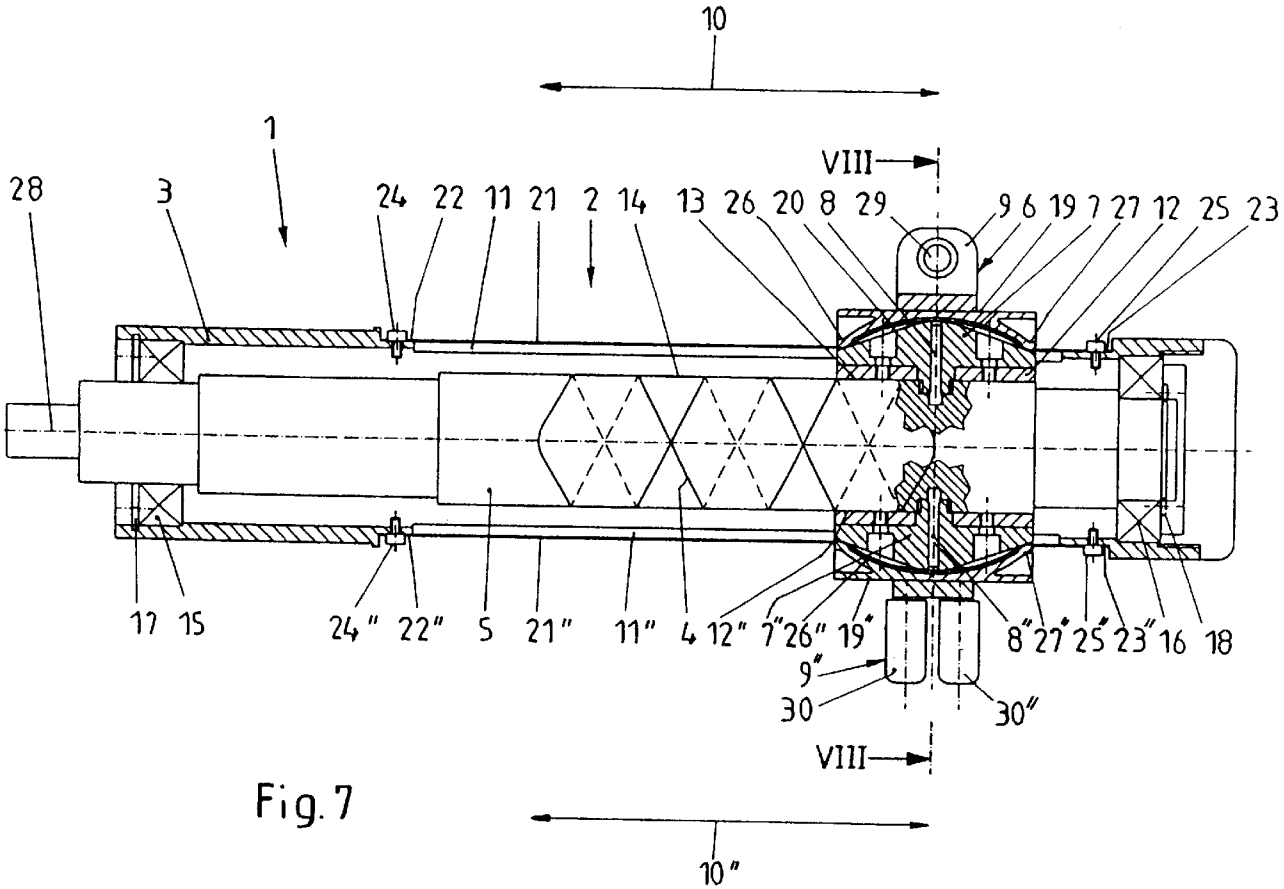
FIG. 7 is a sectional view of another exemplary embodiment of the winding machine including the yarn traversing apparatus.

FIGS. 7 and 8 illustrate another exemplary embodiment of the winding machine 1 including the yarn traversing apparatus 2. In this embodiment, the traversing yarn guide 6 includes two bodies 7, 7" , two shuttles 8, 8" and two yarn guides 9, 9" all being spaced apart by 180 degrees. The two yarn guides 9, 9" extend through two elongated openings 11, 11" also being spaced apart by 180 degrees to protrude out of the housing 3 of the yarn traversing apparatus 2. Accordingly, the housing 3 in the region where the second yarn guide 9" moves is sealed by a sealing strip 21" being fixedly connected to the housing 3 by screws 24", 25". Instead of a lug 29, the yarn guide 9" includes two rollers 30, 30" between which the yarn runs. Different structural designs of the yarn guides 9, 9" are also possible. It is to be seen from FIG. 8 that the shuttle 8" is designed to be identical with the shuttle 8, but it is arranged to be turned by 180 degrees. The shuttle 8" with one of its free ends also engages the channel 4 of the shaft 5.

Figure 10:
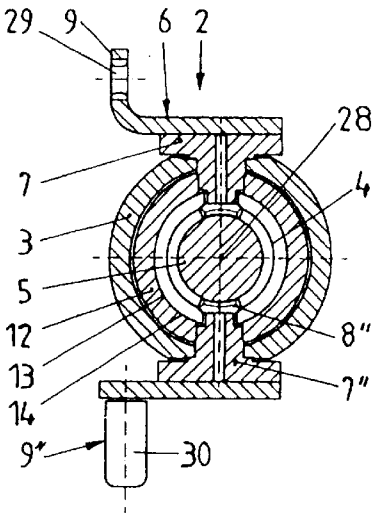
FIG. 10 is a view of a section according to line X—X of the yarn traversing apparatus of FIG. 9.
Figure 9:
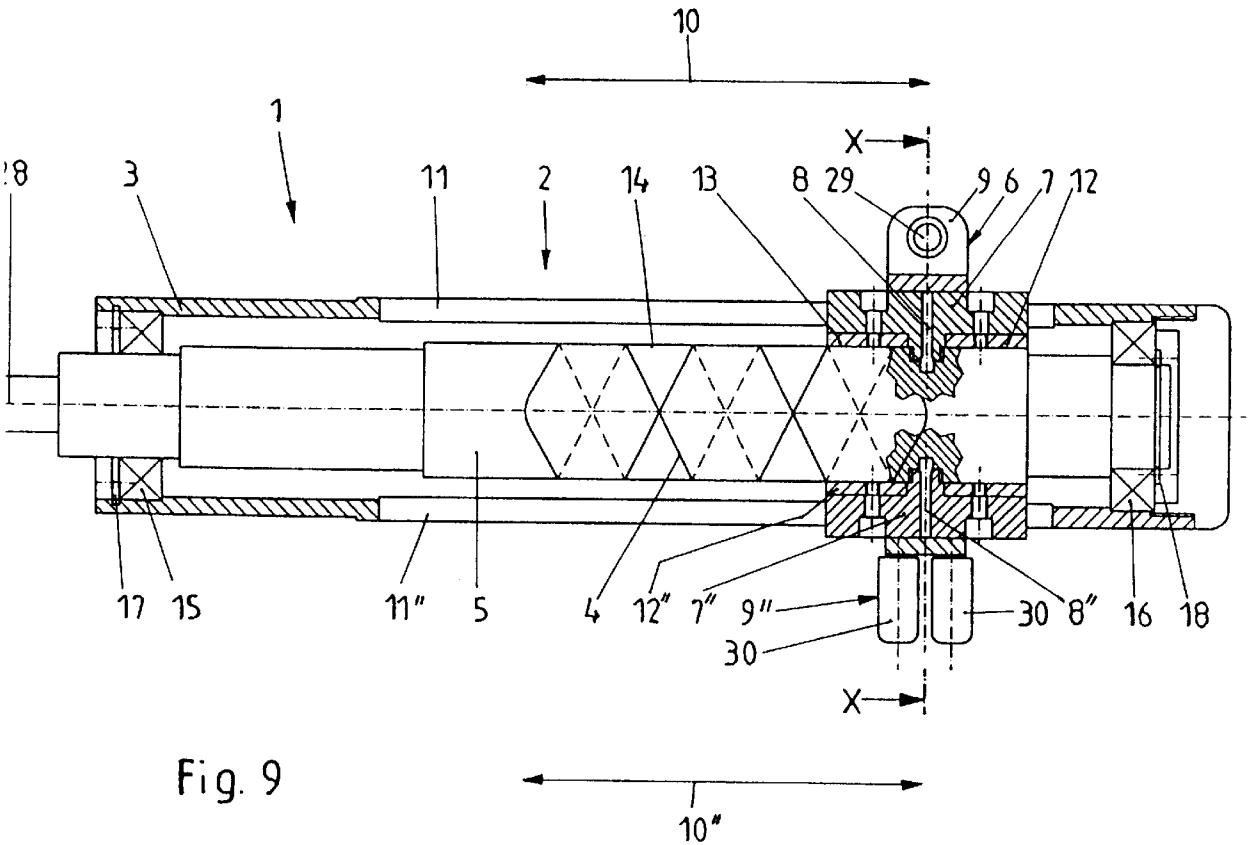
FIG. 9 is a sectional view of another exemplary embodiment of the winding machine including the yarn traversing apparatus.

FIGS. 9 and 10 illustrate another exemplary embodiment of the winding apparatus 1 and of the yarn traversing apparatus 2 being similar to the one of FIGS. 7 and 8. In this embodiment, the housing 3 is not covered or sealed by a cover in combination with a gap and a sealing strip.

Figure 11:
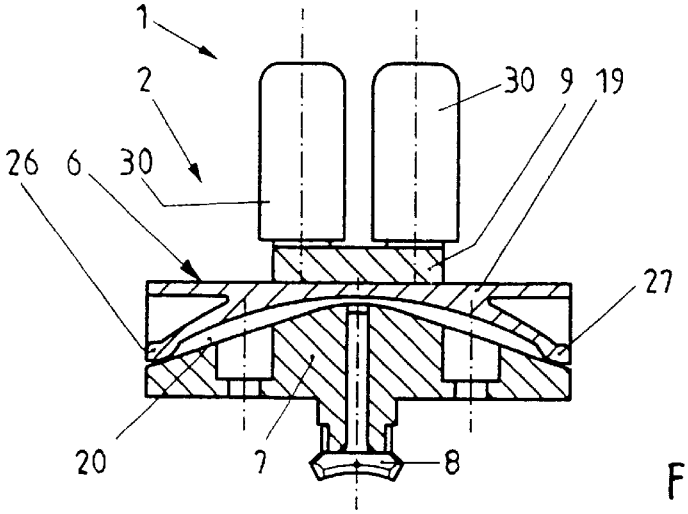
FIG. 11 is a detailed sectional view of the traversing yarn guide.

FIG. 11 illustrates a detailed view of the elements of the traversing yarn guide 6 of the winding machine 1. Especially, the design of the holding-down elements 26, 27 of the traversing yarn guide 6 are to be well seen from this illustration. The holding-down elements 26, 27 serve to press the sealing strip 21 (FIG. 1) down in a direction towards the elongated opening 11 in way that impurities and the like are prevented from entering the interior of the housing 3 (FIG. 1) and the endless groove 4 of the reversing screw thread shaft 5 of the yarn traversing apparatus 2 of the winding machine 1.

FIG. 12 illustrates a schematic view of the general arrangement of parts and elements of the winding machine 1 including the yarn traversing apparatus 2. The winding machine 1 includes a base plate 31 including an elongated hole 32 being formed therein. The elongated hole 32 has a circular axis along which a winding spindle 33 may be moved. A bobbin 34 is located on the winding spindle 33. The yarn 36 is being winded on the bobbin 34 to form a spindle 35. The yarn 36 fulfills its movement due to the movement of the traversing yarn guide 6 and a pressure roller 37 contacting the spindle 35.

Many variations and modifications may be made to the preferred embodiments of the invention without departing substantially from the spirit and principles of the invention. All such modifications and variations are intended to be included herein within the scope of the present invention, as defined by the following claims.

I claim:

1. A winding machine, comprising:

a yarn traversing apparatus including:

a housing having an elongated opening;

a reversing screw thread shaft having an outer surface, being rotatably supported in said housing and including an endless screw thread groove; and a traversing yarn guide including a body, a shuttle being designed and arranged to engage said endless screw thread groove, a yarn guide and a guide bush having an inner surface, said traversing yarn guide being designed and arranged to be driven by said reversing screw thread shaft to reciprocate in an axial direction, said yarn guide being designed and arranged to project out of said elongated opening of said housing, and the inner surface of said guide bush being designed and arranged to at least partially surround the outer surface of said reversing screw thread shaft.

2. The winding machine of claim 1, wherein the inner surface of said guide bush and the outer surface of said reversing screw thread shaft are designed and arranged to form a slide fit.

3. The winding machine of claim 2, wherein said guide bush is designed to be circumferentially closed to completely surround the outer surface of said reversing screw thread shaft.

4. The winding machine of claim 3, wherein said yarn traversing apparatus includes two yarn guides being spaced apart by 180 degrees.

5. The winding machine of claim 2, wherein said guide bush is designed to be partially open in a circumferential direction.

6. The winding machine of claim 2, wherein said reversing screw thread shaft includes a plurality of endless screw thread grooves each being designed and arranged to drive one traversing yarn guide.

7. The winding machine of claim 2, wherein said yarn traversing apparatus includes two yarn guides being spaced apart by 180 degrees.

8. The winding machine of claim 2, wherein said yarn traversing apparatus further includes a sealing strip being designed and arranged to cover said elongated opening of said housing, wherein said traversing yarn guide further includes a cover being connected to said body of said traversing yarn guide, said cover and said body forming a gap between them, and wherein said sealing strip is designed and arranged to extend through said gap.

9. The winding machine of claim 8, wherein said sealing strip has two ends each being fixedly connected to said housing.

10. The winding machine of claim 9, wherein said cover includes two holding-down elements extending in a direction towards said sealing strip.

11. The winding machine of claim 8, wherein said cover includes two holding-down elements extending in a direction towards said sealing strip.

12. The winding machine of claim 8, wherein said sealing strip is designed as a hardened and ground elongated steel strip.

13. The winding machine of claim 1, wherein said guide bush is designed to be circumferentially closed to completely surround the outer surface of said reversing screw thread shaft.

14. The winding machine of claim 13, wherein said yarn traversing apparatus includes two yarn guides being spaced apart by 180 degrees.

15. The winding machine of claim 1, wherein said guide bush is designed to be partially open in a circumferential direction.

16. The winding machine of claim 1, wherein said reversing screw thread shaft includes a plurality of endless screw thread grooves each being designed and arranged to drive one traversing yarn guide.

17. The winding machine of claim 1, wherein said yarn traversing apparatus includes two yarn guides being spaced apart by 180 degrees.

18. The winding machine of claim 1, wherein said yarn traversing apparatus further includes a sealing strip being designed and arranged to cover said elongated opening of said housing, wherein said traversing yarn guide further includes a cover being connected to said body of said traversing yarn guide, said cover and said body forming a gap between them, and wherein said sealing strip is designed and arranged to extend through said gap.

19. The winding machine of claim 18, wherein said sealing strip has two ends each being fixedly connected to said housing.

20. The winding machine of claim 19, wherein said cover includes two holding-down elements extending in a direction towards said sealing strip.

21. The winding machine of claim 18, wherein said cover includes two holding-down elements extending in a direction towards said sealing strip.

22. The winding machine of claim 18, wherein said sealing strip is designed as a hardened and ground elongated steel strip.

23. A yarn traversing apparatus, comprising:

a housing having an elongated opening;

a reversing screw thread shaft having an outer surface, being rotatably supported in said housing and including an endless screw thread groove; and a traversing yarn guide including a body, a shuttle being designed and arranged to engage said endless screw thread groove, a yarn guide and a guide bush having an inner surface, said traversing yarn guide being designed and arranged to be driven by said reversing screw thread shaft to reciprocate in an axial direction, said yarn guide being designed and arranged to project out of said elongated opening of said housing, and the inner surface of said guide bush being designed and arranged to at least partially surround the outer surface of said reversing screw thread shaft.

24. The apparatus of claim 23, wherein the inner surface of said guide bush and the outer surface of said reversing screw thread shaft are designed and arranged to form a slide fit.

25. The apparatus of claim 24, wherein said guide bush is designed to be circumferentially closed to completely surround the outer surface of said reversing screw elements extending in a direction towards said sealing strip.

26. The apparatus of claim 24, wherein said guide bush is designed to be partially open in a circumferential direction.

27. The apparatus of claim 24, wherein said reversing screw thread shaft includes a plurality of endless screw thread grooves each being designed and arranged to drive one traversing yarn guide.

28. The apparatus of claim 23, wherein said guide bush is designed to be circumferentially closed to completely surround the outer surface of said reversing screw thread shaft.

29. The apparatus of claim 23, wherein said guide bush is designed to be partially open in a circumferential direction.

30. The apparatus of claim 23, wherein said reversing screw thread shaft includes a plurality of endless screw thread grooves each being designed and arranged to drive one traversing yarn guide.

* * * * *